US006401890B1

(12) United States Patent
Tan

(10) Patent No.: US 6,401,890 B1
(45) Date of Patent: Jun. 11, 2002

(54) FOLDING COLLAPSIBLE WHEELED LUGGAGE

(76) Inventor: Fu-Hsing Tan, 4th Fl., 101-1, Chi Lin Road, Yang Chou Tsun, Lu Chu, Taoyuan Hsien (TW)

( * ) Notice: Subject to any disclaimer, the term of this patent is extended or adjusted under 35 U.S.C. 154(b) by 0 days.

(21) Appl. No.: 09/873,327

(22) Filed: Jun. 5, 2001

(51) Int. Cl.[7] ..... A45C 13/26

(52) U.S. Cl. ..... 190/107; 190/18 A; 190/127; 150/159

(58) Field of Search ..... 190/18 A, 103, 190/105, 107, 109, 113, 115, 127; 150/159

(56) References Cited

U.S. PATENT DOCUMENTS 3,122,225 A * 2/1964 Ward ..... 190/108 X
4,063,581 A * 12/1977 Williams ..... 190/18 A
4,081,061 A * 3/1978 Tucker ..... 190/108
4,756,394 A * 7/1988 Cohen ..... 190/18 A
5,209,279 A * 5/1993 Wilson ..... 190/108 X
5,515,897 A * 5/1996 Fehan ..... 150/159
5,573,089 A * 11/1996 Liang ..... 190/18 A
5,875,876 A * 3/1999 Wang ..... 190/18 A
6,164,425 A * 12/2000 Latshaw ..... 190/18 A

* cited by examiner

*Primary Examiner*—Lee Young
*Assistant Examiner*—Tri M. Mai
(74) *Attorney, Agent, or Firm*—Troxell Law Office PLLC

(57) ABSTRACT

A folding collapsible wheeled luggage includes a wheeled base, and a folding collapsible cover detachably fastened to the wheeled base by a zip fastener, the folding collapsible cover having a top panel, two side panels and a back panel fixedly fastened together and a front panel detachably fastened to the top panel and the side panels by a zip fastener, the side panels having hinges for enabling the folding collapsible cover to be set between the collapsed condition and the extended condition.

5 Claims, 9 Drawing Sheets

FOLDING COLLAPSIBLE WHEELED LUGGAGE

BACKGROUND OF THE INVENTION

The present invention relates to a wheeled luggage and, more specifically, to a folding collapsible wheeled luggage.

Conventional golf bag carriages and luggage are commonly not folding collapsible. When not in use, these golf bag carriages and wheeled luggage still occupy much storage space. There are known folding collapsible luggage that can be set in a collapsed condition to minimize space occupation when not in use. However, a folding collapsible luggage cannot carry heavy objects.

SUMMARY OF THE INVENTION

The present invention has been accomplished under the circumstances in view. According to one aspect of the present invention, the folding collapsible wheeled luggage comprises a wheeled base, and a folding collapsible cover detachably fastened to the wheeled base by a zip fastener. The wheeled base is strong enough to carry heavy objects. The folding collapsible cover is detachably fastened to the wheeled base to hold and protect storage items. The wheeled base comprises a top open chamber, a carrying handle at the front side, four bottom wheels disposed in four corners of the bottom side, and two side wheels at the rear side. By means of the bottom wheels and the side wheels, the user can carry the folding collapsible wheeled luggage on the floor either in vertical or in a tilted position. According to another aspect of the present invention, the folding collapsible cover comprises a top panel, two side panels and a back panel fixedly fastened together and a front panel detachably fastened to the top panel and the side panels by a zip fastener. When opened the zip fastener, the front panel is folded up, and then the side panels are folded inwards and closely attached to the back panel, and then the back panel is folded up with the side panels to set the folding collapsible cover into a collapsed condition. According to still another aspect of the present invention, the side panels have hinges for enabling the folding collapsible cover to be set between the collapsed condition and the extended condition.

DETAILED DESCRIPTION OF THE PREFERRED EMBODIMENT

Figure 1:
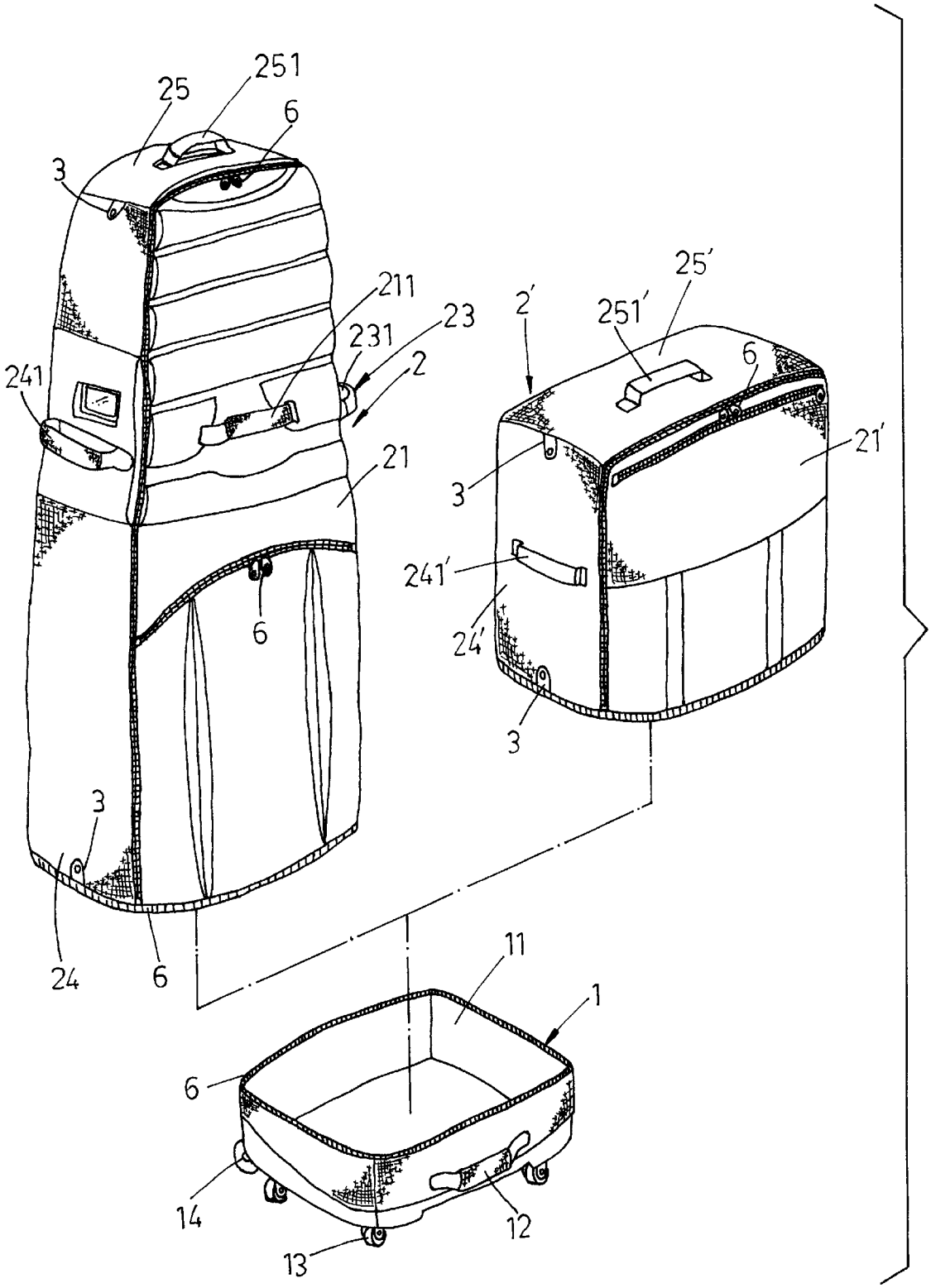
FIG. 1 is an exploded view showing two alternate forms of the present invention.
Figure 2:
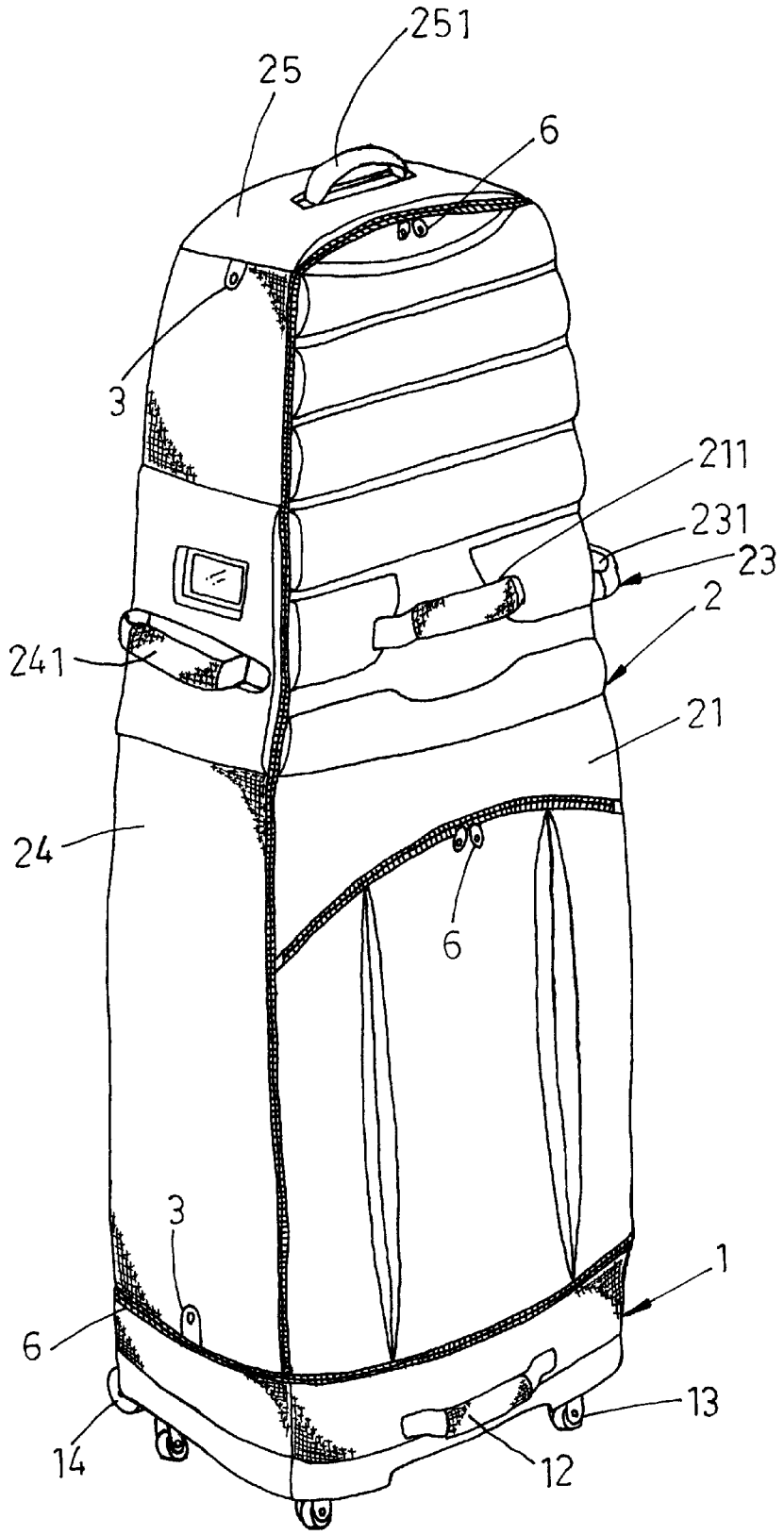
FIG. 2 is an elevational view a folding collapsible wheeled luggage according to a first embodiment of the present invention.
Figure 3:
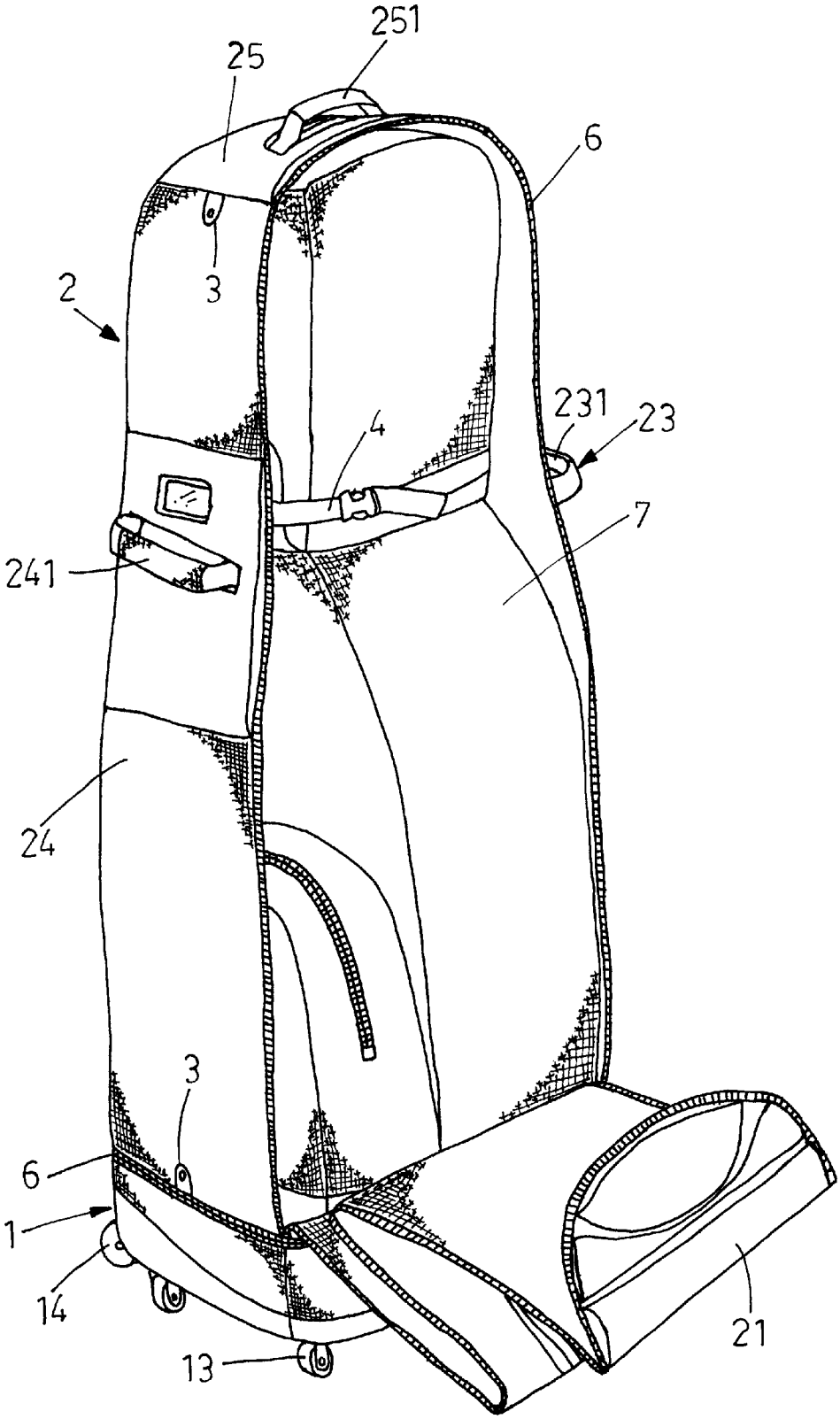
FIG. 3 illustrates an application example of the folding collapsible wheeled luggage according to the first embodiment of the present invention.
Figure 4:
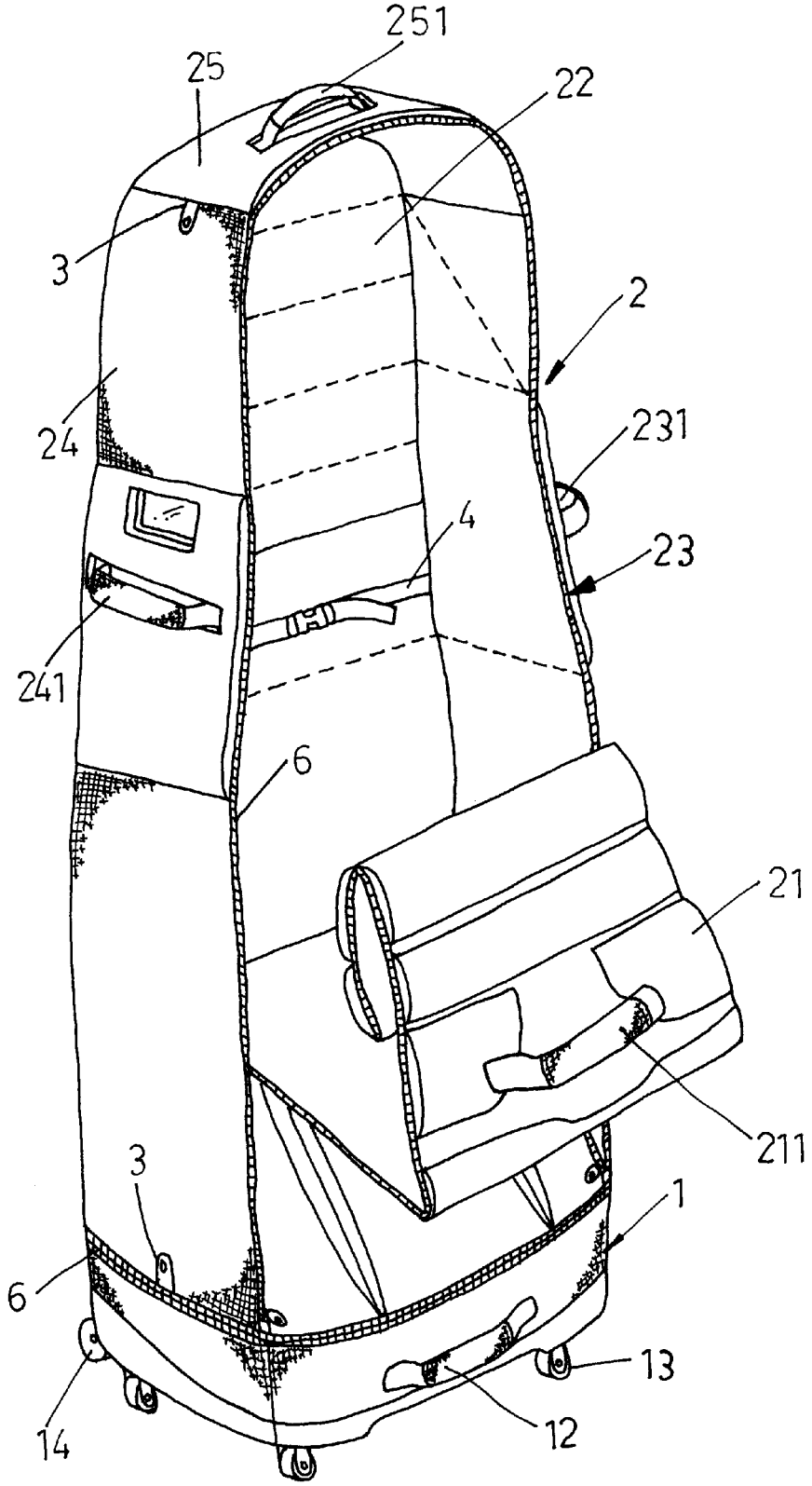
FIG. 4 illustrates the collapsing procedure of the folding collapsible wheeled luggage according to the first embodiment of the present invention (Step I).
Figure 5:
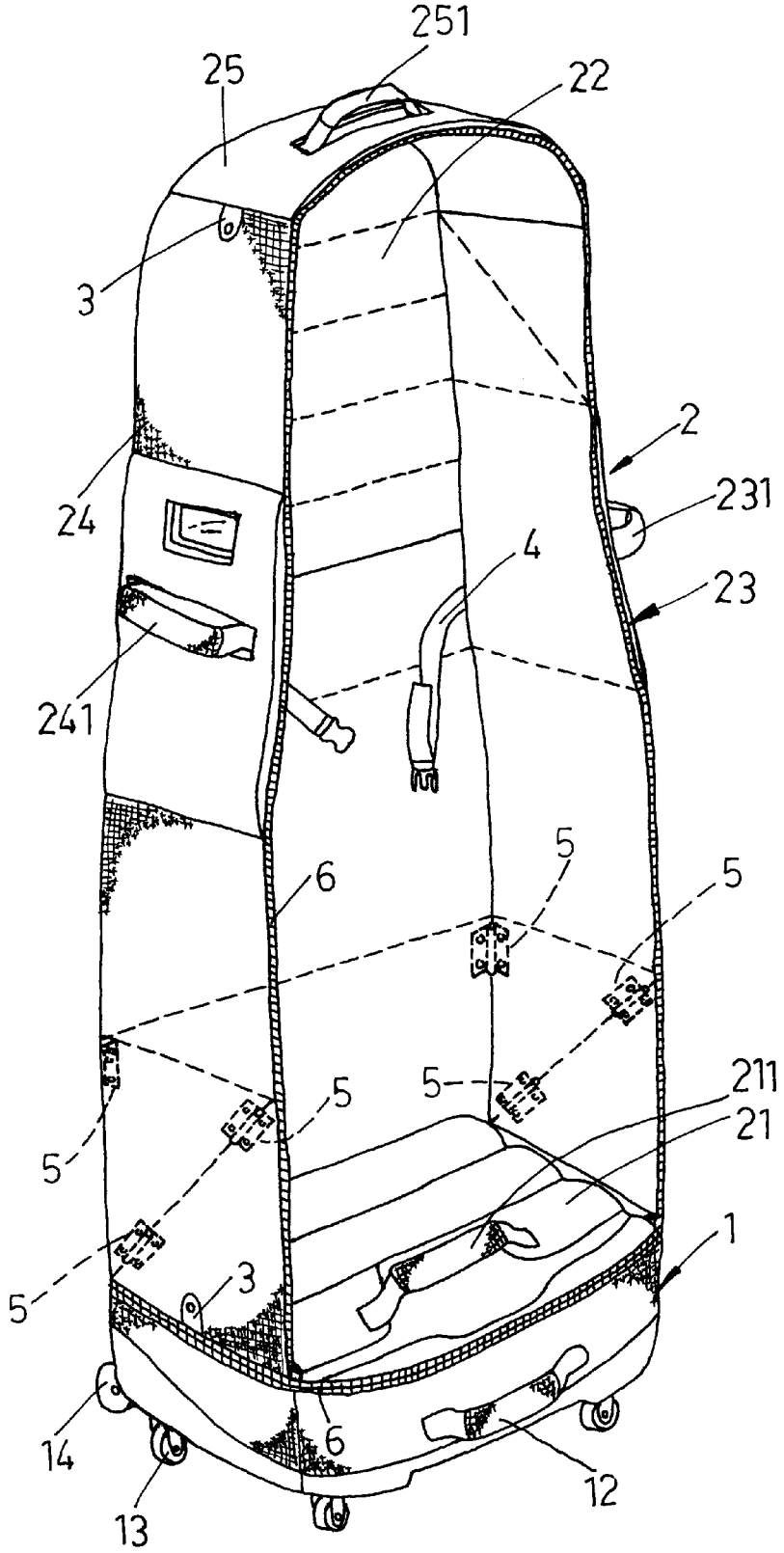
FIG. 5 illustrates the collapsing procedure of the folding collapsible wheeled luggage according to the first embodiment of the present invention (Step II).
Figure 6:
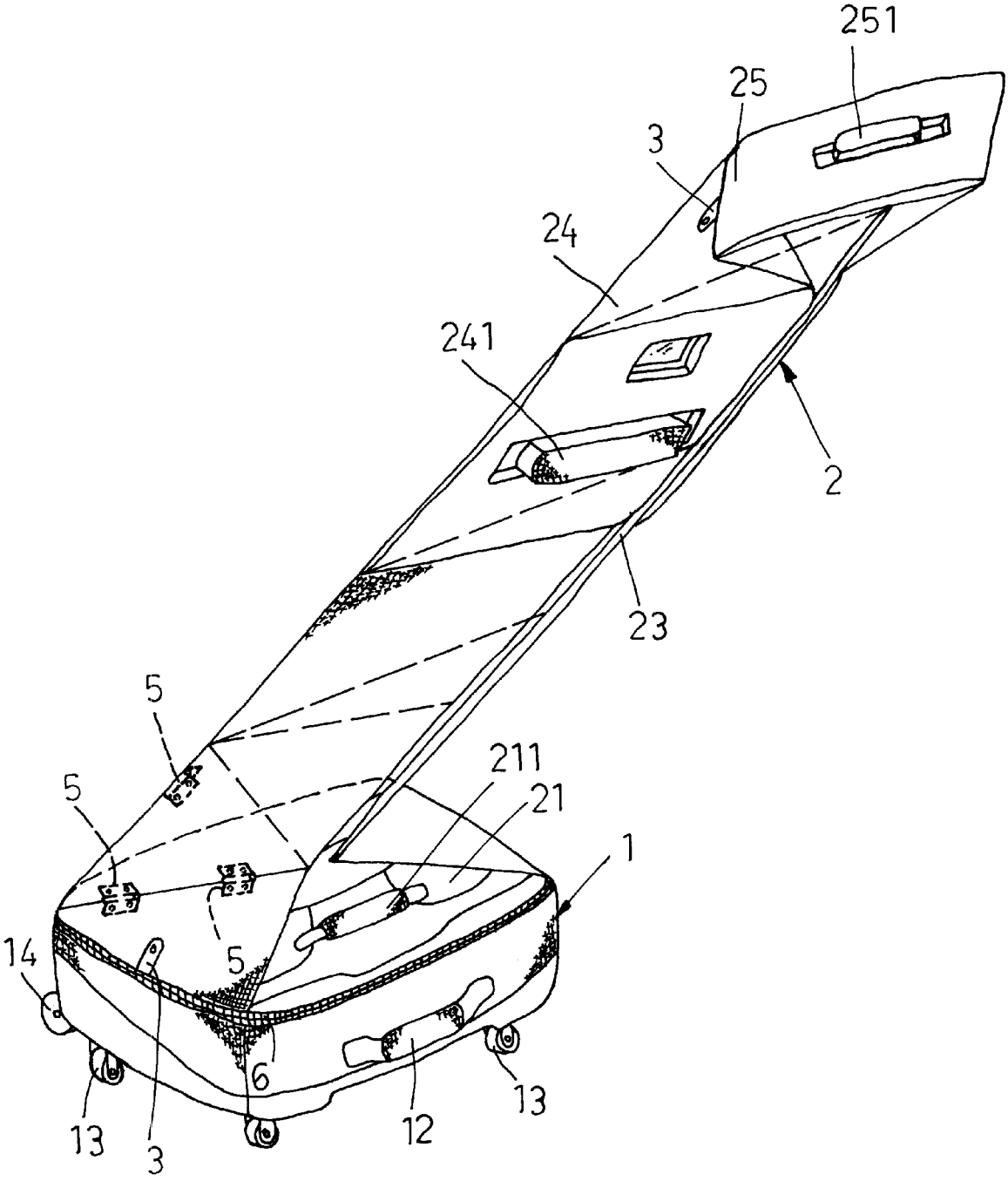
FIG. 6 illustrates the collapsing procedure of the folding collapsible wheeled luggage according to the first embodiment of the present invention (Step III).
Figure 7:
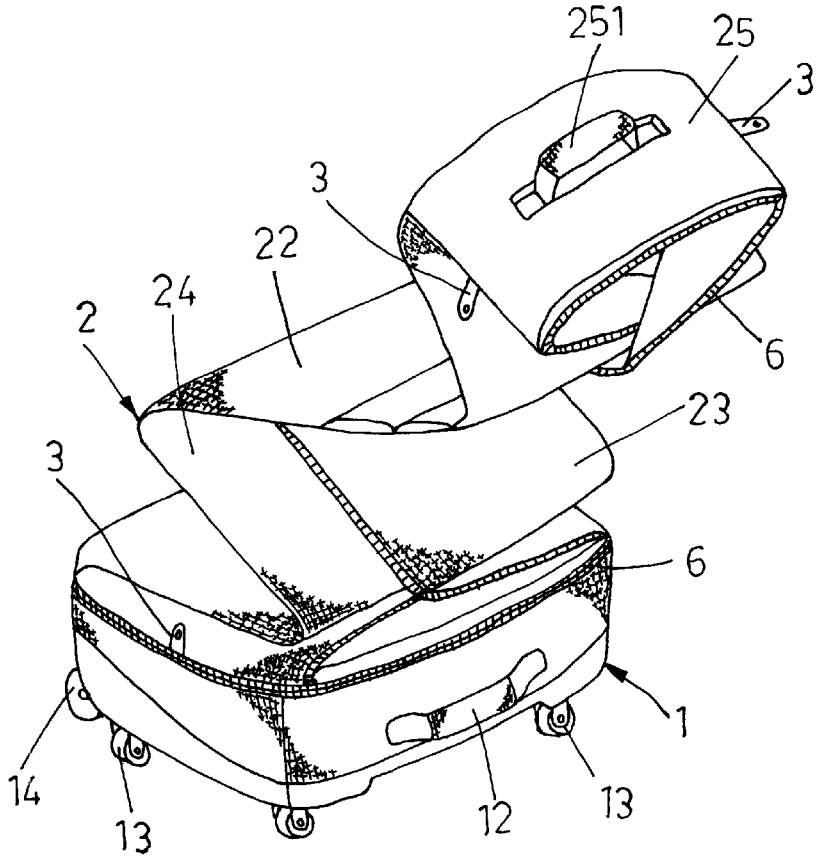
FIG. 7 illustrates the collapsing procedure of the folding collapsible wheeled luggage according to the first embodiment of the present invention (Step IV).
Figure 8:
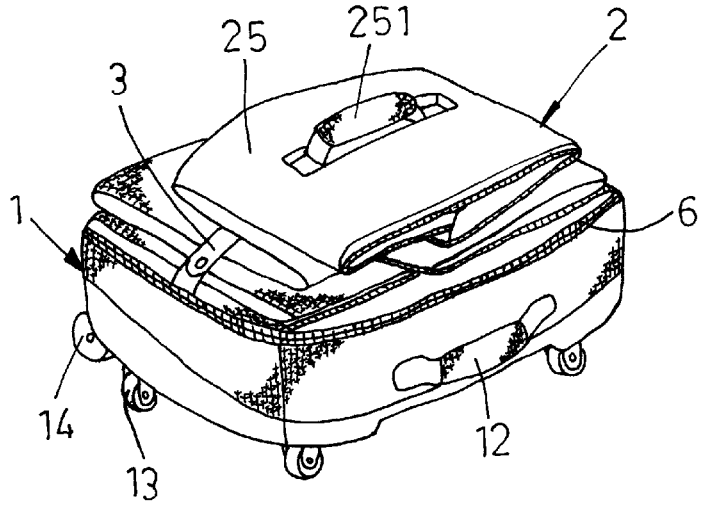
FIG. 8 illustrates the folding collapsible wheeled luggage according to the first embodiment of the present invention set in the collapsed condition.
Figure 9:
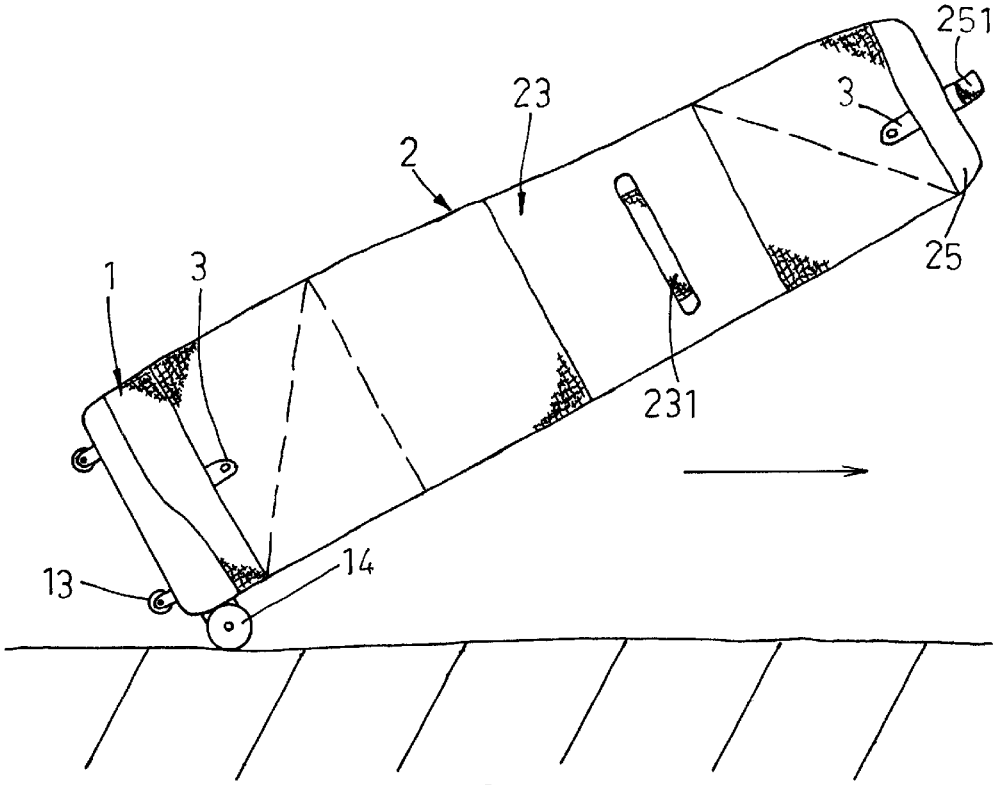
FIG. 9 illustrates the folding collapsible wheeled luggage of the first embodiment of the present invention moved on the floor in a tilted position.
Figure 10:
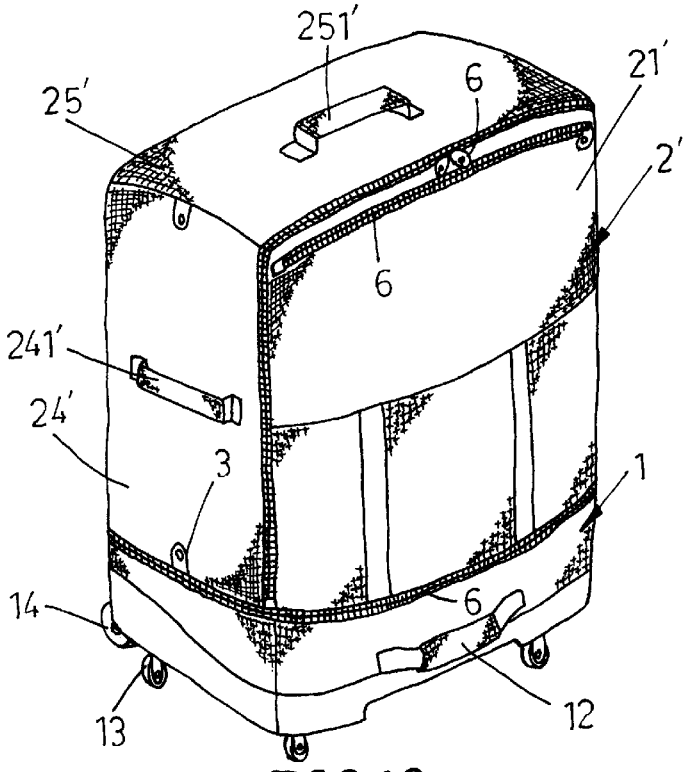
FIG. 10 is an elevational view of a folding collapsible wheeled luggage according to a second embodiment of the present invention.
Figure 11:
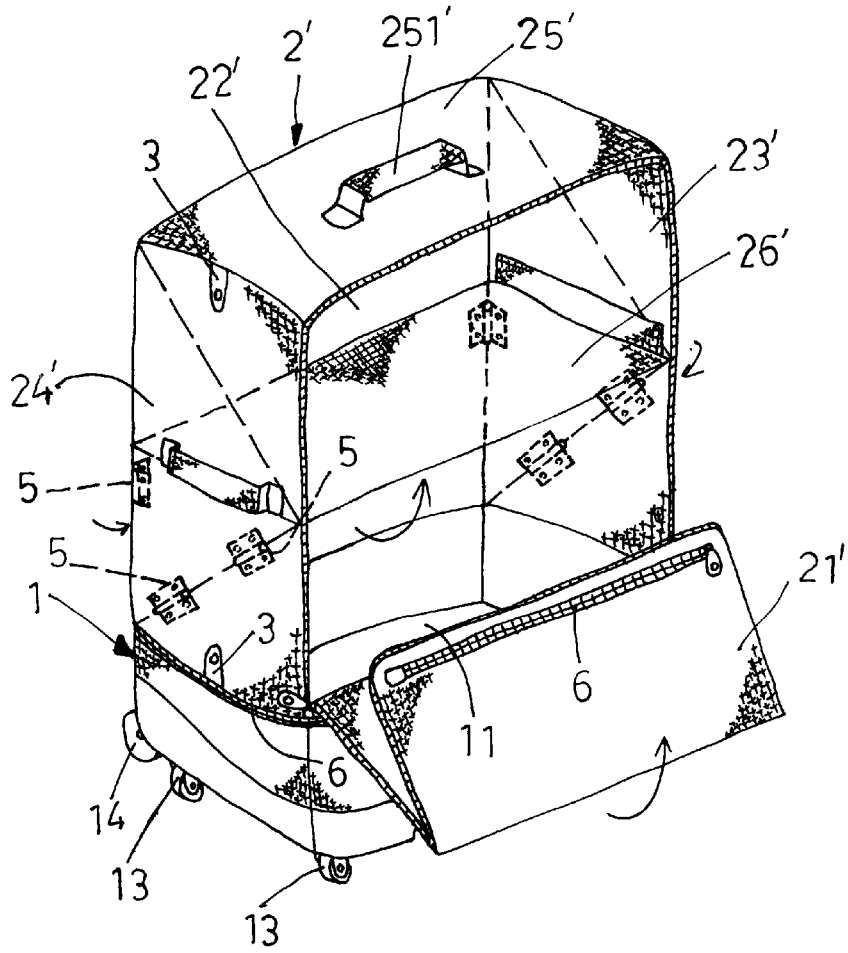
FIG. 11 illustrates the collapsing procedure of the folding collapsible wheeled luggage according to the second embodiment of the present invention
Figure 12:
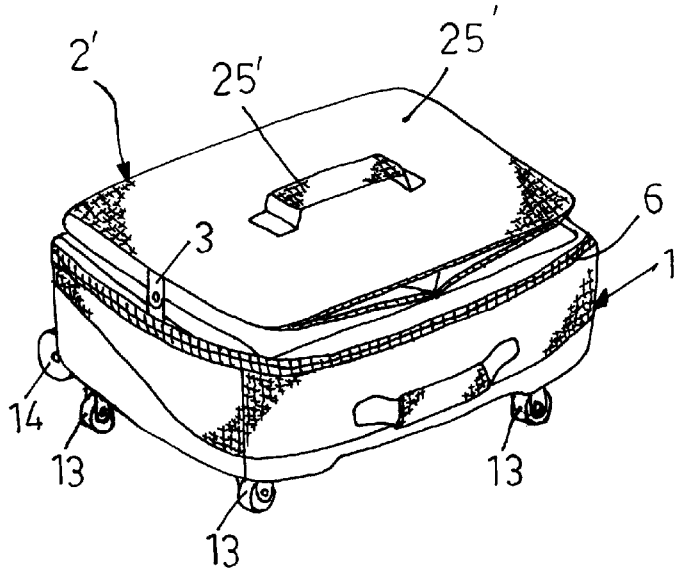
FIG. 12 illustrates the folding collapsible wheeled luggage of the second embodiment of the present invention set in the collapsed condition.

Referring to FIG. 1, a folding collapsible wheeled luggage in accordance with the present invention comprises a wheeled base 1 having a top open chamber 11, and a folding collapsible cover 2 or 2' detachably fastened to the top open chamber 11 of the wheeled base 1 by a zip fastener 6. The wheeled base 1 comprises a carrying handle 12 at a front side thereof, four bottom wheels 13 disposed in the four corners of the bottom side thereof, and two side wheels 14 at the rear side thereof. By means of the bottom wheels 13, the folding collapsible wheeled luggage can be moved on the floor in vertical (see FIG. 2). By means of the side wheels 14, the folding collapsible wheeled luggage can be moved on the floor in a tilted position (see FIG. 9).

Referring to FIGS. from 2 through 4, the folding collapsible cover 2 comprises a front panel 21, a back panel 22, a right panel 23, a left panel 24, and a top panel 25. The panels 21;22;23;24;25 are made of fabrics or collapsible sheet material. Carrying handles 211;221;231;241;251 are respectively provided at the panels 21;22;23;24;25, so that the user can conveniently pull the folding collapsible wheeled luggage from either side. A golf club bag 7 can be carried inside the folding collapsible cover 2. A harness 4 is provided inside the folding collapsible cover 2 and adapted to secure the loaded fold club bag 7 in position. Hooks 3 are respectively provided at the border area of the top panel 25.

Referring to FIGS. from 4 through 8, the front panel 21 is detachably fastened to the right panel 23, the top panel 25 and the left panel 24 by a zip fastener 6. After the zip fastener 6 has been opened, the front panel 21 is folded up and received in a flat manner inside the top open chamber 11 of the wheeled base 1, and then the right panel 23 and the left panel 24 are respectively folded inwards and closely attached to the back panel 22, and then the back panel 22 is folded up with the right panel 23 and the left panel 24, keeping the top panel 25 disposed at the top side, and then the collapsed folding collapsible cover 2 is secured in the collapsed condition by hooking the hooks 3 in the wheeled base 1.

Further, the right panel 23 and the left panel 24 have hinges on the inside such that the right panel 23 and the left panel 24 can easily be folded up and arranged into the collapsed condition, or quickly extended out from the collapsed condition. When extended out, the hinges 5 support the folding collapsible cover 2 in the extended position.

FIGS. from 10 through 12 show an alternate form of the folding collapsible cover. According to this alternate form, the folding collapsible cover 2' comprises a front panel 21', a back panel 22', a right panel 23', a left panel 24', a top panel 25', and a partition panel 2. The front panel 21 is detachably fastened to the right panel 23, the top panel 25 and the left panel 24 by a zip fastener. The partition panel 2 is connected between the right panel 23 and the left panel 24 to separate the holding space of the folding collapsible cover 2 into two vertically spaced storage chambers for holding different items. After the zip fastener has been opened, the front panel 21 is folded up and received inside the wheeled base 1, and then the right panel 23 and the left panel 24 are respectively folded inwards and then folded up with the back panel 22 . When collapsed, the top panel 25 is disposed at the top side, and the hooks 3 which are provided at the border area of the top panel 25 are respectively fastened to the wheeled base 1 to secure the collapsed folding collapsible cover 2 in position. Further, the right panel 23 and the left panel 24 are provided with hinges 5 such that the right panel 23 and the left panel 24 can be conveniently folded up or extended out.

A prototype of folding collapsible wheeled luggage has been constructed with the features of FIGS. 1~12. The folding collapsible wheeled luggage functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A folding collapsible wheeled luggage comprising a wheeled base, said wheeled base comprising a top open chamber, a carrying handle at a front side thereof, four bottom wheels disposed in four corners of a bottom side thereof, and two side wheels at a rear side thereof, and a folding collapsible cover detachably fastened to the top open chamber of said wheeled base by a zip fastener, wherein said folding collapsible cover comprises a collapsible front panel, a collapsible back panel, a collapsible right panel, a collapsible left panel, and a collapsible top panel, a zip fastener detachably securing said front panel to said right panel, said left panel and said top panel, and hinge means respectively provided at said right panel and said left panel for enabling said right panel and said left panel to be arranged between a collapsed condition and an extended condition.

2. The folding collapsible wheeled luggage of claim 1 wherein said folding collapsible cover further comprises a plurality of carrying handles respectively provided at said front panel, said back panel, said right panel, said left panel, and said top panel.

3. The folding collapsible wheeled luggage of claim 1 wherein said folding collapsible cover further comprises a partition panel connected between said right panel and said left panel.

4. The folding collapsible wheeled luggage of claim 1 wherein said folding collapsible cover further comprises harness adapted to secure storage means in position.

5. The folding collapsible wheeled luggage of claim 1 wherein said folding collapsible cover further comprises a plurality of hooks respectively disposed around said top panel for hooking in said wheeled base to secure said folding collapsible cover in position when collapsed.

* * * * *